United States Patent [19]

Price

[11] Patent Number: 4,899,814

[45] Date of Patent: Feb. 13, 1990

[54] HIGH PRESSURE GAS/LIQUID HEAT EXCHANGER

[76] Inventor: Richard C. Price, 9816 Frankstown Rd., Pittsburgh, Pa. 15235

[21] Appl. No.: 138,358

[22] Filed: Dec. 28, 1987

Related U.S. Application Data

[63] Continuation-in-part of Ser. No. 948,154, Dec. 31, 1986, abandoned.

[51] Int. Cl.[4] ..... F28D 7/02

[52] U.S. Cl. ..... 165/163; 165/172; 165/159

[58] Field of Search ..... 165/163, 159, 171, 172, 165/71

[56] References Cited

U.S. PATENT DOCUMENTS

| | | | |
|---|---|---|---|
| 1,940,963 | 12/1933 | McIntyre | 165/172 |
| 2,286,271 | 6/1942 | Higham | 165/172 |
| 2,347,957 | 5/1944 | McCullough | 165/172 |
| 2,475,604 | 7/1949 | Frisch et al. | 165/159 |
| 2,569,824 | 10/1951 | Nall | 165/159 |
| 3,130,780 | 4/1964 | Winship | 165/163 |
| 3,563,303 | 2/1971 | Gilli et al. | 165/163 |
| 3,717,200 | 2/1973 | Pavilon | 165/163 |
| 4,158,387 | 6/1979 | McDonald | 165/71 |
| 4,643,244 | 2/1987 | Bosworth | 165/159 |
| 4,653,577 | 3/1987 | Noda | 165/71 |

*Primary Examiner*—James C. Yeung

*Attorney, Agent, or Firm*—Buchanan Ingersoll

[57] ABSTRACT

A heat exchanger for use with high pressure gases is disclosed which has a generally cylindrical shell through which pressurized gas is passed. A plurality of stacked, high pressure, fluid-carrying serial coils are arranged in parallel serpentine paths within a frame member to form a structurally independent unit. The frame member is attached to an inner support member provided within the shell to position and align the frame member and coils. In operation, the coils are arranged primarily transverse to the flow of the gas, yet, because of the serpentine path, the flow of fluid through the coils is counter to or parallel with the flow of gas in the shell. The frame member supports the serpentine coils and contains any vibrations of the coils caused by the shell gases passing over the coils.

11 Claims, 3 Drawing Sheets

HIGH PRESSURE GAS/LIQUID HEAT EXCHANGER

CROSS-REFERENCE TO RELATED APPLICATIONS

This is a continuation in part of my U.S. Patent Application Ser. No. 948,154, abandoned.

BACKGROUND OF THE INVENTION

1. Field of the Invention

This invention relates to the field of heat exchangers and more specifically to the field of heat exchangers used with high pressure gases and liquids.

2.Description of the Prior Art

Conventional gas/liquid heat exchangers normally employ a square or rectangular box-like housing having within them either bare tubes or tubes equipped with fins or other surface extensions. Although this design can be used for high pressure gases, it is not cost effective. To withstand the high pressure exerted by the gas on flat surfaces, the walls of the heat exchanger must be reinforced with thick plates which exceed two inches in thickness.

Conventional heat exchangers have also employed straight tubes in a cylindrical shell. The tubes proceed longitudinally within the cylindrical shell and may make several longitudinal passes before exiting the shell.

Although these conventional heat exchangers are satisfactory for basic heat exchange needs, they are not adequate in specialized situations involving gases under pressures which exceed 3 p.s.i. In these situations, the shell must be large enough to provide a sufficient surface area as to allow adequate heat exchange. To accommodate a large volume of high pressure gas such as is involved in steel furnaces, the shell must either have a cost-prohibitive length or diameter and must also be reinforced by thick plates.

These conventional heat exchangers are also not adequate in containing the vibration of the coils caused by the gas passing over the tubes. Consequently, coil length is restricted and the volume of high pressure gas which the heat exchangers can handle is reduced. Accordingly, there is a need for a heat exchanger which will efficiently handle the volume of high pressure gas produced in a steel furnace.

SUMMARY OF THE INVENTION

In accordance with the invention, I provide a heat exchanger wherein the heat exchange coils are maintained structurally independent of the heat exchanger shell. A plurality of heat exchange coils adapted to carry a high pressure fluid are arranged on a series of parallel serpentine paths. The serpentine coils include a series of parallel coil segments connected by U-shaped elbows.

The coils of my heat exchanger are supported by a frame member which includes both tube holder sheets and solid plates. Solid plates are provided parallel to the serpentine paths and positioned along both sides of the series of parallel serpentine coils. At least one tube holder sheet is provided perpendicular to the serpentine path and is secured in place by its connection to the solid plates. The tube holder sheet contains openings which receive and secure the coils against vibration. Preferably, a tube holder sheet is provided at either end of the serpentine coil where the coil segments are connected to the U-shaped elbows. At these locations, the tube holder sheets secure the coils at the position to control the resonance effect.

The frame member and coils are preferably placed in and engaged with a heat exchanger shell which is generally cylindrical in shape. The shell has a cylindrical heat exchange zone located between two transition cones. The diameter of the shell increases through the transition cones reaching a maximum at the heat exchanging zone. The heat exchanger is designed to withstand the flow of a high pressure gas. The frame member should be positioned within the heat exchanger shell such that the tube holder sheets are aligned with the longitudinal axis of the shell.

In operation, high pressure gas, such as that from a steel furnace, passes through the shell; a fluid, such as water, passes through the coils. The fluid-carrying coils are arranged so that they are primarily transverse to the flow of gas through the heat exchanger shell. Additionally, because of the serpentine path of coils, the fluid flow within the coils can be directed counter to the gas flow through the shell. The provision of coils which are both transverse and counter to the flow of the gas provides better heat transfer between the liquid in the coils and the gas than conventional systems having parallel coils which are in line with the gas stream.

Because my heat exchanger provides better heat transfer, a much smaller heat exchanger is used. Additionally, because of the cylindrical shape of the shell, no reinforcement plates are needed for the shell to withstand the high pressures of the gas. Finally, because tube sheets secure the most vulnerable portions of the serpentine coils, higher volumes and flow rates of gas can be used. Accordingly, my design provides a compact heat exchanger which can be used with high pressure gases and high pressure liquids.

DESCRIPTION OF THE PREFERRED EMBODIMENT

Figure 1:
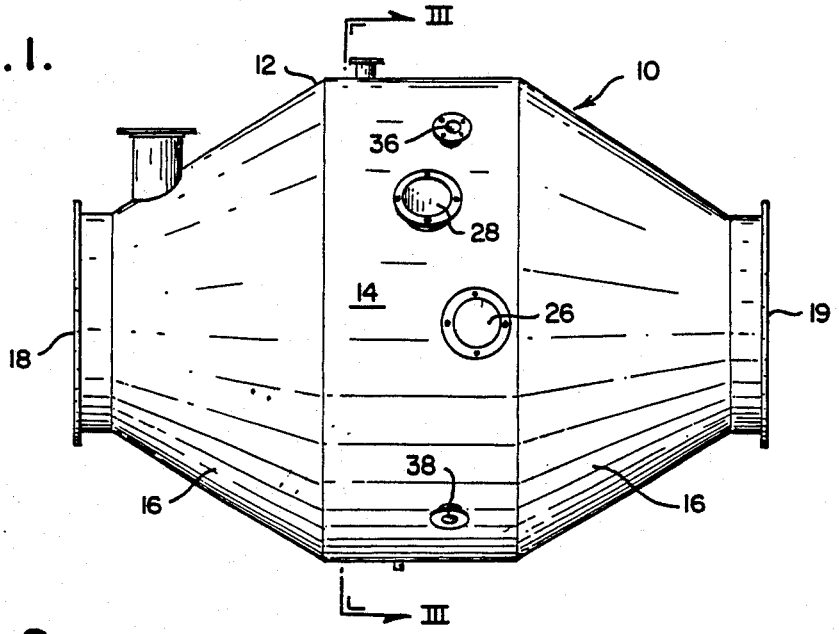
FIG. 1 is a side elevational view of a preferred embodiment of the heat exchanger of my invention.
Figure 2:
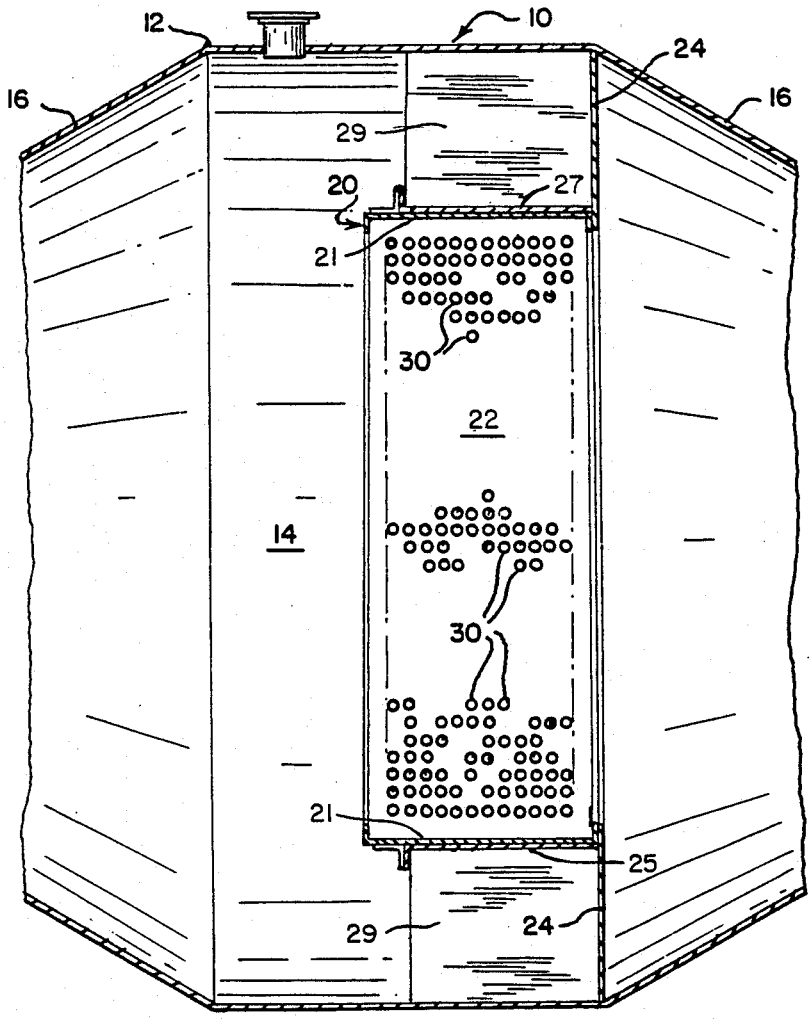
FIG. 2 is a partial vertical sectional view of the heat exchanger of FIG. 1 taken along the line II—II of FIG. 3.

As shown in FIGS. 1 and 2, my heat exchanger 10 contains a generally cylindrical shell 12. Shell 12 serves as the conduit for the gas which travels in the heat exchanger. Pressurized gas is fed into the heat exchanger 10 through a pipe (not shown) connected to one end 18 of shell 12 and exits from the opposite end 19. An outlet pipe (not shown) is connected to end 19 for remoVal of the gas. Shell 12 has three zones: a centrally disposed heat exchange zone 14 located between two transition cones 16. The diameter of shell 12 increases from a minimum at the ends 18 and 19 of such transition cones 16 to a maximum at the heat exchange zone 14.

Frame member 20 having tube holder plates 22 and solid plates 21 is fitted into shell 12 within heat exchange zone 14. Frame member 20 supports a plurality of serial coils 30 which run through substantially parallel planes which extend along the longitudinal axis of shell 12. Extended surface tubes 31 may be used for coils 30 Baffles 24 are located at one end of frame ember 20 and force the gas flowing through shell 12 to pass within frame member 20. Inlet header 26 and outlet header 28 both pass through the wall of shell 12 within heat exchanging zone 14, providing inlet and outlet means for the liquid which is circulated through the heat exchanger.

Figure 4:
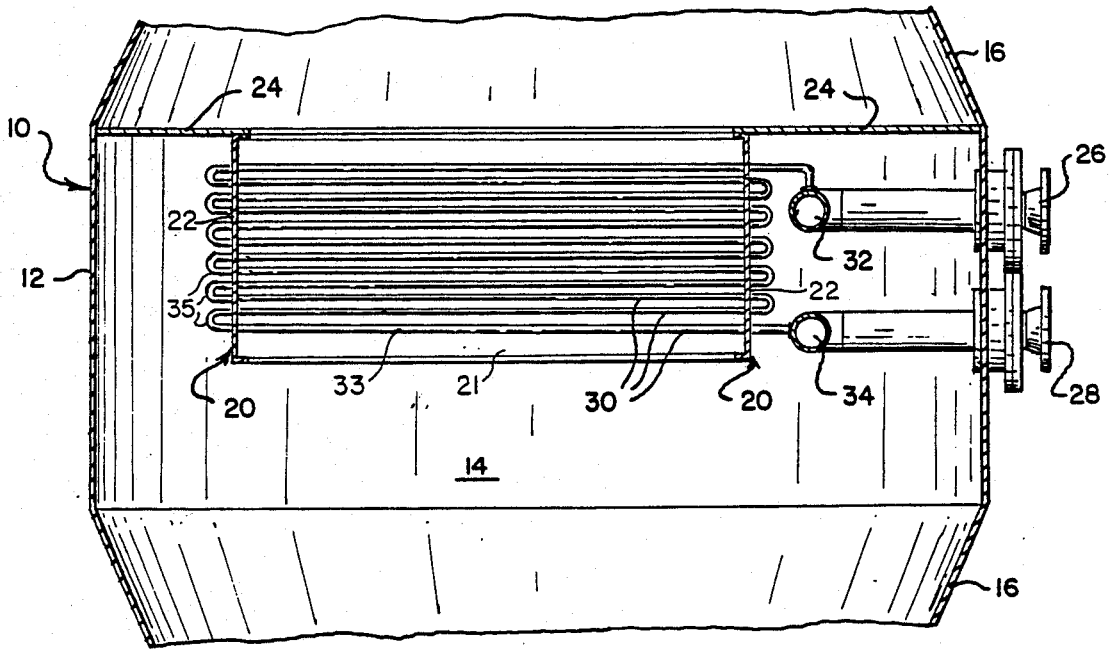
FIG. 4 is a partial horizontal sectional view of the heat exchanger of FIG. 1 taken along the line IV—IV of FIG. 3.
Figure 3:
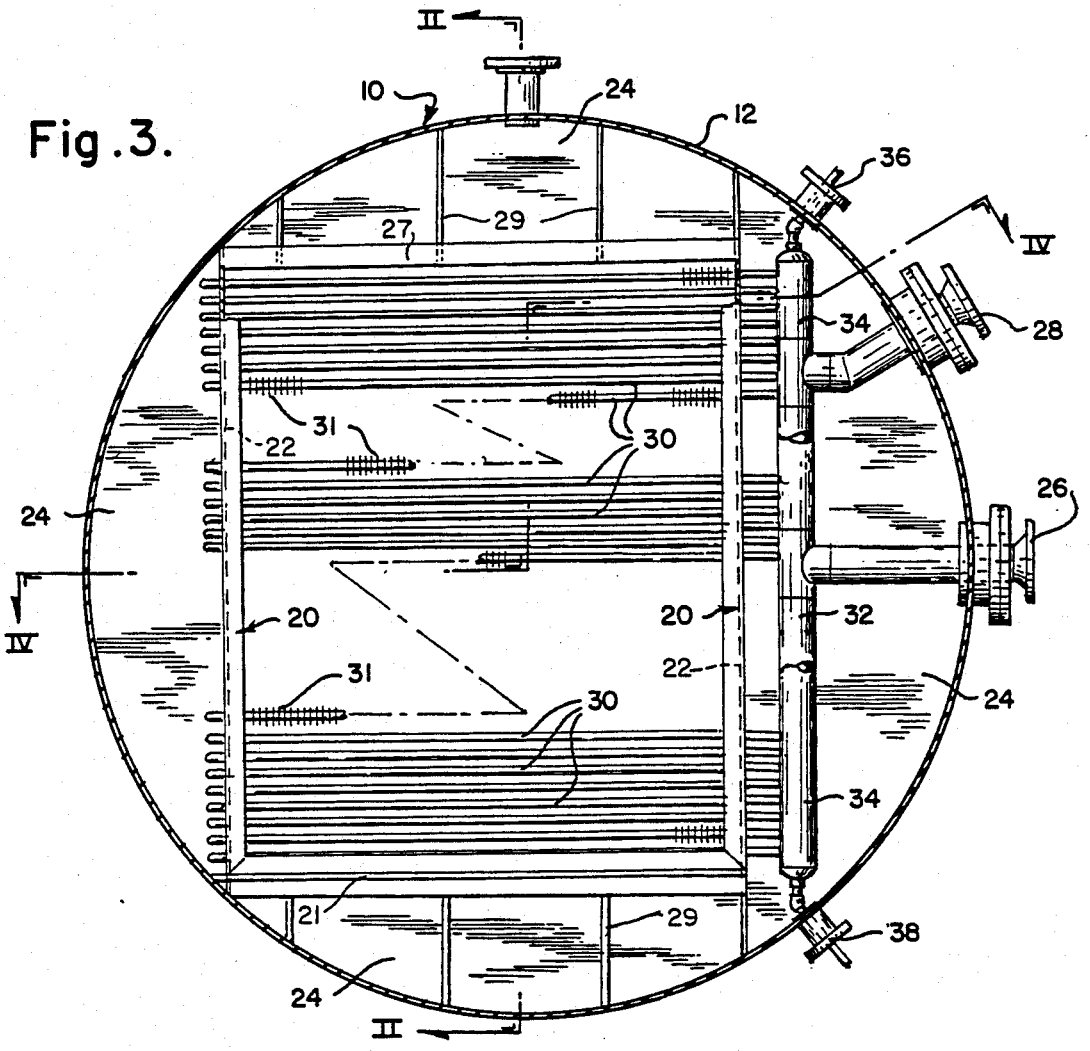
FIG. 3 is a transverse sectional view of the heat exchanger of FIG. 1 taken along the line III—III of FIG. 1.

As shown in FIGS. 3 and 4, a series of stacked serpentine coils 30 is secured within frame member 20 with each coil being in one of several generally parallel planes. The coils 30 provide conduit means for a liquid such as water, oil or a combination of water and oil, to pass through the heat exchanger. Coils 30 are connected at one end to inlet tube 32 and at the other end to outlet tube 34. Inlet tube 32 and outlet tube 34 are perpendicular to the stacks of coils 30 secured within frame member 20 and are connected to inlet header 26 and outlet header 28, respectively.

Coils 30 are wrapped around frame member 20 to form coil segments 33 which are primarily transverse to the longitudinal axis of shell 12. U-shaped elbows 35 are used to connect two adjacent coil segments 33 and thus provide a means for continuous flow of the fluid within the coils 30. Preferably, the coils 30 are arranged within the shell 12 such that outlet tube 34 is downstream of inlet tube 34. In this manner, the coils 30 are primarily transverse to the direction of flow of the gas and the flow of fluid within the coils is counter to the flow of the gas. Alternatively, the flow of the fluid within the coils 30 may be parallel with the flow of the gas within the shell 12.

Figure 5:
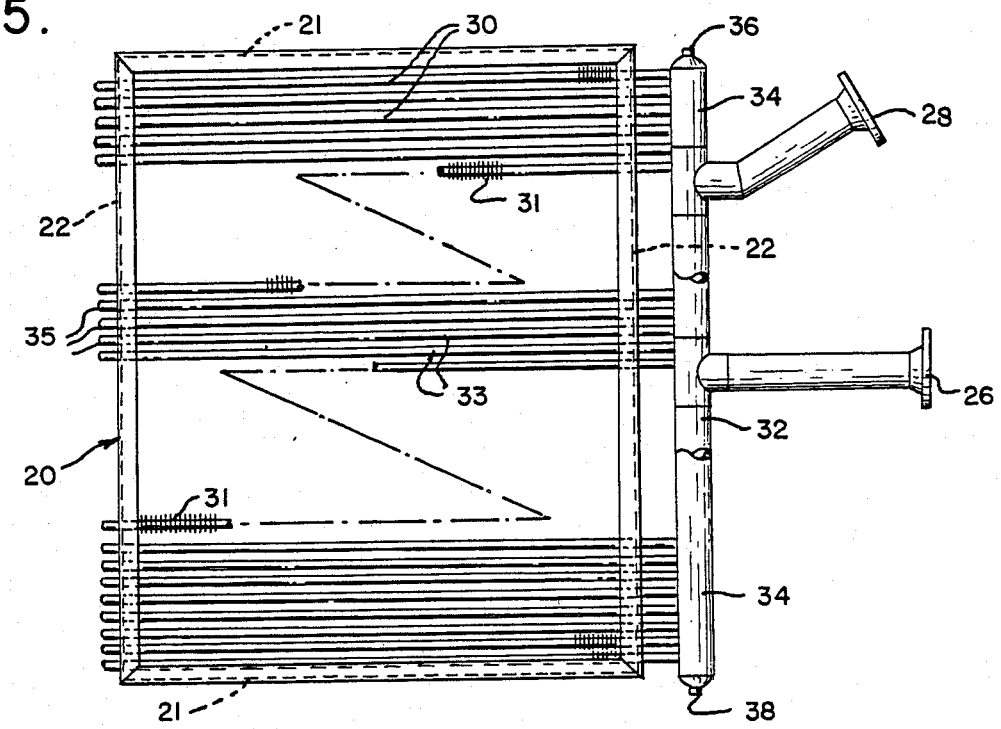
FIG. 5 is an elevational view of the heat exchanger coils and frame removed from the heat exchanger zone.

As shown in FIG. 5, the coils 30 and frame member 20 are structurally independent of the remainder of my heat exchanger 10. Frame member 20 includes solid plates 21 and tube holder plates 22. Tube holder plates 22 are provided with openings through which the coils 30 are passed and secured. Preferably, tube holder sheets are provided in a plane perpendicular to the series of stacked coils 30 and at a position at or near the connection of the coil segment 33 and U-shaped elbow 35. The tube holder plates 22 are secured by solid plates 21 which are positioned in plane parallel with the stacked coils 30.

Figure 6:
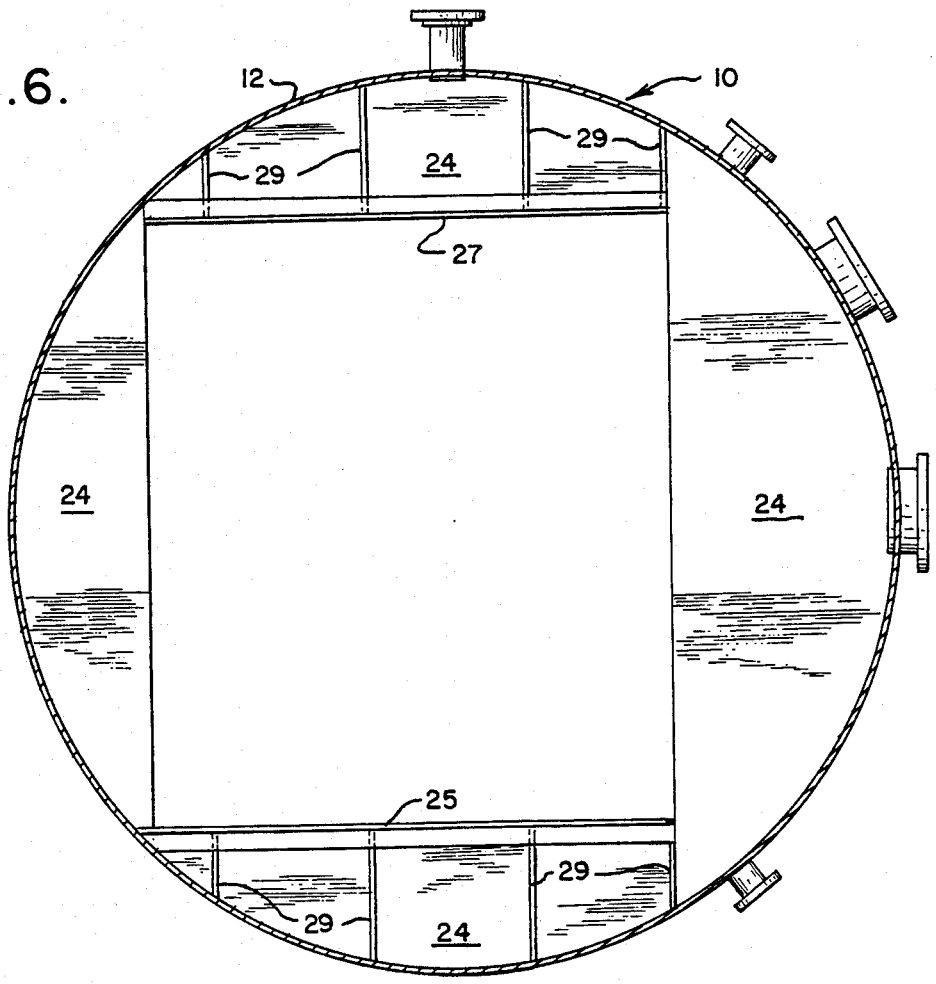
FIG. 6 is a transverse sectional view of the heat exchanger shell of FIG. 1 after removal of the heat exchanger coils and frame.

As shown in FIG. 6, various openings such as vent 36, drain 38, inlet header 26 and outlet header 28 are provided directly through shell 12. Inner support frames 25 and 27 are provided within shell 12 and are supported by gussets 29. When assembled for operation, solid plates 21 of frame member 20 fit between inner support frames 25 and 27. I prefer to use bolts (not shown) to align heat exchange coils 30 and frame member 20 within shell 12. Even when bolted in place the heat exchange coils 30 and frame 20 are structurally independent of the shell 12.

By using a structurally independent coil structure, my heat exchanger 10 can withstand greater flow rates of high pressure gas than conventional heat exchangers. When the gas passes by the coils 30, the air causes the coils 30 to resonate. The vibrations caused by high gas flow rates can cause unsupported coils 30 to fracture or pull apart from the inlet tube 32 and outlet tube 34. To prevent excessive vibration, I provide the tube plates 22 at the position where they will dampen most of the vibrations. Accordingly, I place the tube plates 22 at or near the connection of coil segments 33 and U-shaped elbow 35. Such a heat exchanger will have the same vibration containment effect of a heat exchanger having only a plurality of transverse tubes. However, my heat exchanger 10 also has the advantage of having a fluid flow in the coils 30 counter to the gas flow in the shell 12.

In operation, a hot, high pressure gas, such as that which exhausts from a steel furnace, travels through the inside of shell 12 of the heat exchanger 10. A liquid medium, such as high pressure water, passes through the coils 30 and is heated. Baffles 24 provide that the gas must flow through frame 20 and contact coils 30. Vent 36 is located at or near one end of inlet tube 32 or outlet tube 34 to vent any gas which may have built up in the liquid medium. Drain 38 is located at or near the opposite end of inlet tube 32 or outlet tube 34 and is used to drain coils 30 when exchanger 10 is inoperative.

The counter flow transverse coils 30 of my design are more advantageous than conventional parallel coils because they can be more efficiently arranged in a given space than parallel coils. This permits the heat exchanger to have a more compact design which reduces the cost of the exchanger. Furthermore, better heat transfer occurs between the gas and the coils 30 because the gas is forced against the coils 30 and must make several passes over the same coil 30. Finally, better heat transfer occurs because the flow of fluid in the coils 30 is counter to the flow of gas in the shell 12.

Because the shell 12 of heat exchanger 10 is cylindrical, it is better able to withstand the high pressures of furnace gases than conventional rectangular heat exchangers. The cylindrical shell of my design does not require reinforcement plates in order to support high pressure gases. I have found that a thickness of only ½ inch for the shell 12 of my heat exchanger 10 is satisfactory for handling gas pressures of 70 to 100 psi. Conventional heat exchangers of comparable size would require plates having a thickness in the range of 8–12 inches.

While I have shown and described certain presently preferred embodiments of my invention, it is to be distinctly understood that the invention is not limited thereto and may be otherwise variously practiced within the scope of the following claims.

I claim:

1. A heat exchanger for use with high pressure gases comprising:

at least one serial coil positioned in a plane, said at least one coil following a serpentine path along said plane;

a frame member provided in a shell and adapted to support said at least one coil and contain vibrations of said at least one coil, said frame member comprising at least one tube holder sheet having openings provided therein adapted to receive and secure said at least one coil, and at least two solid plates adapted to secure said tube holder sheet in a fixed position to the shell;

and an inner support frame provided within said shell, said support frame sized and positioned to engage said solid plates of said frame member and align and position said frame member within said shell.

2. The heat exchanger of claim 1 wherein said at least one tube holder sheet is positioned transverse to said plane containing said at least one coil.

3. The heat exchanger of claim 2 wherein said at least two solid plates are positioned parallel to said plane containing said at least one coil.

4. The heat exchanger of claim 1 wherein said serpentine path of said at least one coil comprises a plurality of generally parallel coil segments connected by generally U-shaped elbows.

5. The heat exchanger of claim 4 wherein a tube sheet secures said coil segments at a position near the connection of the coil segment and the U-shaped elbow.

6. A heat exchanger for use with high pressure gases comprising:

at least one serial coil positioned in a plane, said at least one coil following a serpentine path along said plane;

a frame member adapted to support said at least one coil and contain vibrations of said at least one coil, said frame member comprising at least one tube holder sheet having openings provided therein adapted to receive and secure said at least one coil, and at least two solid plates adapted to secure said tube holder sheet in a fixed position;

a generally cylindrical shell having a longitudinal axis through which said gas flows, and shell adapted to engage said frame member;

at least one inlet header passing directly through said shell for conveying a liquid medium to said at least one coil; and inner support frames provided within said shell, said support frames sized and positioned to engage said solid plates of said frame member and align and position said frame member within said shell.

7. The heat exchanger of claim 6 wherein said frame member is positioned within said shell such that said at least one tube sheet and said at least one solid plate are aligned with said longitudinal axis of said shell.

8. The heat exchanger of claim 6 further comprising:

at least one inlet tube connected between said inlet header and said at least one coil for receiving the liquid medium from said inlet header and conveying it to said at least one coil; and at least one outlet tube connected between said outlet header and said at least one coil for receiving the liquid medium from said at least one coil and conveying it to said inlet header.

9. The heat exchanger of claim 6 also comprising baffles attached within said shell and located downstream of said frame member for forcing said gas to pass through said frame member and contact said coils supported on said frame member.

10. The heat exchanger of claim 6 wherein said at least one coil is formed from one of extended surface tubes, bare tubes, and combined bare and extended surface tubes.

11. A heat exchanger for use with high pressure gases comprising:

at least one serial coil positioned in a plane, said at least one coil followed a serpentine path along said plane;

a frame member adapted to support said at least one coil and contain vibrations of said at least one coil, said frame member comprising at least one tue holder sheet having openings provided therein adapted to receive and secure said at least one coil, and at least two solid plates adapted to secure said tube holder sheet in a fixed position;

a generally cylindrical shell having a longitudinal axis through which said gas flows, said shell adapted to engage said frame member;

at least one inlet header passing directly through said shell for conveying a liquid medium to said at least one coil;

at least one outlet header passing directly through said shell for conveying a liquid medium from said at least one coil; and baffles attached within said shell and located downstream of said frame member for forcing said gas to pass through said frame member and contact said coils supported on said frame member, wherein said frame member is engaged with said shell by means of said baffles.

* * * * *

UNITED STATES PATENT AND TRADEMARK OFFICE

CERTIFICATE OF CORRECTION

PATENT NO. : 4,899,814

DATED : February 13, 1990

INVENTOR(S) : RICHARD C. PRICE

It is certified that error appears in the above-identified patent and that said Letters Patent is hereby corrected as shown below:

Column 2, line 65, change "removal" to --removal--.

Column 3, line 9, change "ember" to --member--.

Column 5, line 27, change "and" to --said--.

Column 5, line 31, delete "and".

Column 5, line 32, after "coil" insert the following as a subparagraph:

at least one outlet header passing directly through said shell for conveying a liquid medium from said at least one coil; and Column 6, line 23, change "tue" to --tube--.

Signed and Sealed this

Fifth Day of March, 1991

*Attest:*

HARRY F. MANBECK, JR.

*Attesting Officer*

*Commissioner of Patents and Trademarks*